US007244352B2

(12) United States Patent
Halbert et al.

(10) Patent No.: US 7,244,352 B2
(45) **Date of Patent: *Jul. 17, 2007**

(54) SELECTIVE HYDROPROCESSING AND MERCAPTAN REMOVAL

(75) Inventors: Thomas R. Halbert, Baton Rouge, LA (US); Craig A. McKnight, Sherwood Park (CA); John P. Greeley, Annandale, NJ (US); Bruce R. Cook, Stewartsville, NJ (US); Garland B. Brignac, Clinton, LA (US); Mark A. Greaney, Upper Black Eddy, PA (US); Robert C. Welch, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 486 days.

This patent is subject to a terminal disclaimer.

(21) Appl. No.: 10/359,860

(22) Filed: Feb. 7, 2003

(65) Prior Publication Data

US 2003/0188992 A1 Oct. 9, 2003

Related U.S. Application Data

(63) Continuation-in-part of application No. 09/551,007, filed on Apr. 18, 2000, now abandoned.

(51) Int. Cl.
*C10G 45/00* (2006.01)
*C10G 19/00* (2006.01)

(52) U.S. Cl. ..... 208/212; 208/203; 208/204; 208/206

(58) Field of Classification Search ..... 208/212, 208/203, 204, 206
See application file for complete search history.

(56) References Cited

U.S. PATENT DOCUMENTS

| | | | | |
|---|---|---|---|---|
| 1,796,621 | A | 3/1931 | Ramage | |
| 1,968,842 | A | 8/1934 | Malisoff | 196/24 |
| 1,973,499 | A | 9/1934 | Morrell | 196/24 |
| 2,059,075 | A | 10/1936 | Yabroff et al. | 196/32 |
| 2,153,166 | A | 3/1939 | Yabroff | 196/32 |
| 2,152,720 | A | 4/1939 | Yabroff | 196/32 |
| 2,152,721 | A | 4/1939 | Yabroff | 196/32 |
| 2,152,723 | A | 4/1939 | Yabroff | 196/32 |
| 2,160,632 | A | 5/1939 | Yabroff | 196/32 |
| 2,168,078 | A | 8/1939 | Yabroff | 196/32 |

(Continued)

FOREIGN PATENT DOCUMENTS

GB 1174407 12/1969

OTHER PUBLICATIONS

Satchell, Donald P., Jr., "Effect of Olefins on Hydrodesulfurization of a Cracked Naphtha Reformer Feed," Michigan State University, East Lansing, Michigan, 1969.

(Continued)

*Primary Examiner*—Glenn A. Caldarola
*Assistant Examiner*—John Douglas
(74) *Attorney, Agent, or Firm*—J. J. Kliebert; Lawrence E. Carter

(57) ABSTRACT

A process for producing a naphtha having a decreased amount of sulfur by selective hydroprocessing a petroleum feedstream comprising cracked naphtha to reduce its sulfur content with minimum loss of octane. The reduced sulfur naphtha stream contains mercaptan sulfur reversion products that are removed preferably by use of an aqueous base solution containing a catalytically effective amount of a phase transfer catalyst.

13 Claims, 2 Drawing Sheets

U.S. PATENT DOCUMENTS

| | | | | |
|---|---|---|---|---|
| 2,183,801 | A | 12/1939 | Yabroff | 196/32 |
| 2,186,398 | A | 1/1940 | Yabroff | 196/32 |
| 2,212,105 | A | 8/1940 | Yabroff | 196/32 |
| 2,212,106 | A | 8/1940 | Yabroff | 196/32 |
| 2,212,107 | A | 8/1940 | Yabroff | 196/32 |
| 2,297,866 | A | 10/1942 | Benedict | 196/32 |
| 2,309,651 | A | 2/1943 | McCullough et al. | 196/32 |
| 2,425,777 | A | 8/1947 | Adams et al. | 196/30 |
| 2,437,348 | A | 3/1948 | Brown et al. | 196/32 |
| 2,570,277 | A | 10/1951 | Ricards, Jr. et al. | 196/32 |
| 2,593,851 | A | 4/1952 | Cool et al. | 196/32 |
| 2,608,519 | A | 8/1952 | Deters et al. | 196/24 |
| 2,634,230 | A | 4/1953 | Arnold et al. | 196/24 |
| 2,740,747 | A | 3/1956 | Sweetser et al. | 208/203 |
| 2,776,929 | A | 1/1957 | Vanderbilt | 196/32 |
| 2,792,332 | A | 5/1957 | Hutchings | 196/14.17 |
| 3,098,033 | A | 7/1963 | Welsang et al. | 208/227 |
| 4,124,493 | A | 11/1978 | Frame | 208/206 |
| 4,156,641 | A | 5/1979 | Frame | 208/207 |
| 4,206,079 | A | 6/1980 | Frame | 252/428 |
| 4,290,913 | A | 9/1981 | Frame | 252/428 |
| 4,337,147 | A | 6/1982 | Frame | 208/206 |
| 4,626,341 | A | 12/1986 | Verachtert | 208/235 |
| 4,753,722 | A | 6/1988 | Le et al. | 208/207 |
| 4,824,818 | A | 4/1989 | Bricker et al. | 502/163 |
| 5,167,797 | A | 12/1992 | Ou | 208/236 |
| 5,273,646 | A | 12/1993 | Frame et al. | 208/189 |
| 5,290,427 | A | 3/1994 | Fletcher et al. | 208/89 |
| 5,582,714 | A | 12/1996 | Forte | 208/237 |
| 5,840,177 | A | 11/1998 | Weers et al. | 208/208 R |
| 5,961,819 | A | 10/1999 | Lee et al. | 208/230 |
| 5,985,136 | A | 11/1999 | Brignac et al. | 208/216 R |
| 6,007,704 | A | 12/1999 | Chapus et al. | 208/218 |
| 6,013,175 | A | 1/2000 | Weers et al. | 208/208 R |
| 6,013,598 | A | 1/2000 | Lapinski et al. | 502/305 |
| 6,171,478 | B1 | 1/2001 | Cabrera et al. | 208/212 |
| 6,228,254 | B1 | 5/2001 | Jossens et al. | 208/212 |

OTHER PUBLICATIONS

Holbrook, D.L. UOP, Des Plaines, Illinois, "UOP Merox Process," Chapter 11.30 (Handbook of Petroleum Refining Processes, Robert A. Meyers, Editor in Chief, Second Edition), published by McGraw-Hill, date unknown.

California Oil World, Petroleum Publishers, Inc., C. Monroe, President and Editor, Second Issue, Apr. 1944, vol. 37, No. 8, Whole No. 1655, p. 1, Apr. 27, 1944.

Moriarity, F.C., Universal Oil Products Co., Chicago, "Unisol Treatment Effects Large Savings for Big West Oil Company," California Oil World, Petroleum Publishers, Inc., Second Issue, Apr. 1944, pp. 19-20.

Border, L.E., Shell Oil Co., Inc., Wood River, Illinois, "Solutizer—A New Principle Aplied to Gasoline Sweetening," Chemical & Metallurgical Engineering, Nov. 1940, pp. 776-778.

Moriarity, F.C., Universal Oil Products Co., Chicago, "Effective Method for Reducing Mercaptans Cuts Refining Costs," Petroleum World, pp. 53-55, date unknown.

Yabroff, D.L. and White, E.R., Shell Development Company, Emeryville, California, "Action of Solutizers in Mercaptan Extraction," Industrial and Engineering Chemistry, Jul. 1940, pp. 950-953.

Band, C.H., and Cluer, A., "Application of the Unisol Process in Great Britain," Petroleum, Sep. 1958, pp. 305-308.

Lyles, H.R., Cities Service Refining Corporation, Lake Charles, Louisiana, "New Unisol Stripper Improves Operations," Petroleum Refiner, Mar. 1955, pp. 207-209.

Mason, C.F., Bent, R.D., and McCullough, J.H., The Atlantic Refining Co., Philadelphia, PA., "Naphtha Treating 'Pays Its Way'," Division of Refining, vol. 22[III], 1941, pp. 45-51.

Moriarity, F.C., "Unisol Process for Treating Gasoline," (Mercaptans Removed by Extraction with Concentrated Solution of Caustic Soda Containin Methanol), The Petroleum Engineer, Apr. 1944, pp. 150-152.

Bent, R.D. and McCullough, J.H., "Unisol Process," The Oil and Gas Journal, Sep. 9, 1948, pp. 95, 97, 100, 103.

Mason, C.F., Bent, McCullough, Atlantic Refining Co., Philadelphia, PA., "Naphtha Treating Pays Its Way," The Oil and Gas Journal, Nov. 6, 1941, pp. 114, 116, 119.

O'Donnell, John P., "Tannin Solutizer Process Practically Automatic; Saves 6.5 Cents Per Barrel," The Oil and Gas Journal, Engineering and Operating Section, Jul. 1, 1944, pp. 45-47.

Border, L.E., Shell Oil Co., Inc., "Shell Operating First Solutizer Treating Plant at Wood River," The Oil and Gas Journal, Engineering and Operating Sections, Nov. 7, 1940, pp. 55-56.

Lowry Jr., C.D. and Moriarity, F.C., "Unisol Process Improves Octane Number and TEL Susceptibility," The Oil and Gas Journal, Nov. 3, 1945, pp. 105, 107, 109.

Field, H.W., Atlantic Refining Co., Philadelphia, PA., "Caustic-Methanol Mercaptan Extraction Process Used," The Oil and Gas Journal, Sep. 25, 1941, pp. 40-41.

Mercaptan Reversion Limits HDS of HCN using RT-225 Catalyst

Mercaptan Reversion Limits HDS HCN using Conventional Catalyst KF-742

SELECTIVE HYDROPROCESSING AND MERCAPTAN REMOVAL

CROSS-REFERENCE TO RELATED APPLICATIONS

This application is a continuation-in-part of U.S. patent application Ser. No. 09/551,007 filed Apr. 18, 2000 ABN.

FIELD OF THE INVENTION

A process is disclosed for the production of naphtha streams from cracked naphthas having sulfur levels which help meet future EPA gasoline sulfur standards (30 ppm range and below).

BACKGROUND OF THE INVENTION

Environmentally driven regulatory standards for motor gasoline (mogas) sulfur levels will result in the widespread production of 120 ppm S mogas by the year 2004 and 30 ppm by 2006. In many cases, these sulfur levels will be achieved by hydrotreating naphtha produced from Fluid Catalytic Cracking (cat naphtha), which is the largest contributor to sulfur in the mogas pool. As a result, techniques are required that reduce the sulfur in cat naphthas without reducing beneficial properties such as octane.

Conventional fixed bed hydrotreating can reduce the sulfur level of cracked naphthas to very low levels, however, such hydrotreating also results in severe octane loss due to extensive reduction of the olefin content. Selective hydrotreating processes such as SCANfining have recently been developed to avoid massive olefin saturation and octane loss. Unfortunately, in such processes, the liberated $H_2S$ reacts with retained olefins forming mercaptan sulfur by reversion. Such processes can be conducted at severities that produce product within sulfur regulations, however, significant octane loss also occurs.

Hence, what is needed in the art is a process which produces sulfur levels within regulatory amounts and which minimizes loss of product octane.

SUMMARY OF THE INVENTION

Figure 1:
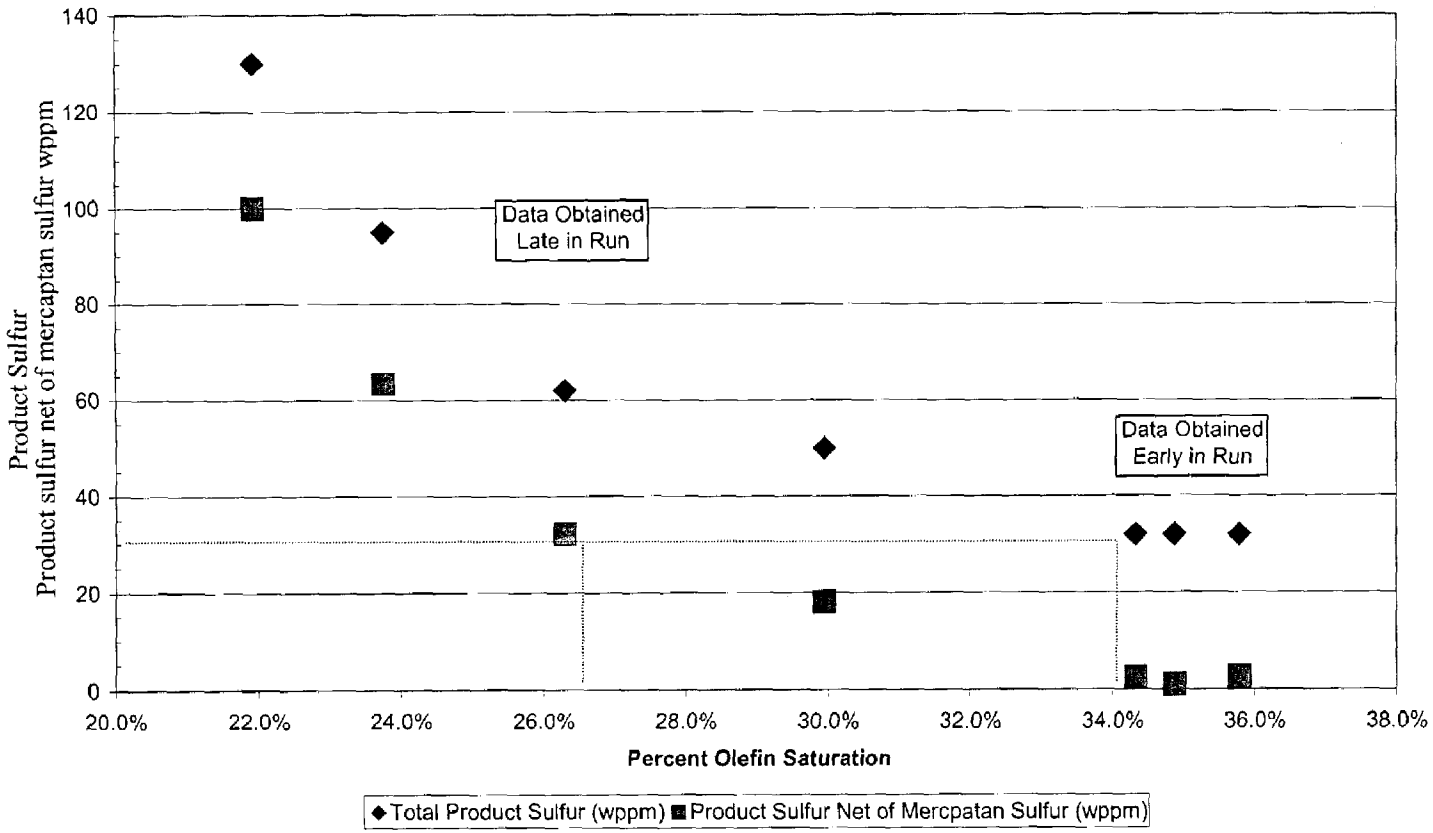
FIG. 1 illustrates the degree to which mercaptan reversion can limit HDS of HCN using an RT-225 catalyst. The Y axis shows both total product sulfur (wppm), and product sulfur minus sulfur resulting from reversion mercaptans (wppm). The X axis is percent olefin saturation.

The invention describes a method for producing a naphtha having a decreased amount of sulfur comprising the steps of:

a) selectively hydroprocessing a petroleum feedstream comprising cracked naphtha and sulfur-containing species to produce a first naphtha product comprising mercaptan reversion sulfur species having at least 5 carbon atoms, and olefins wherein said hydroprocessing results in the conversion of greater than 95% of the organic sulfur species in said petroleum feedstream; and b) removing or converting said mercaptan reversion sulfur species from said first product to obtain a second product having a decreased amount of mercaptan reversion sulfur species.

As used herein, said desired or target amount of non-mercaptan sulfur is that amount the refiner deems acceptable in the finished product following step (b) of the process. Typically, the desired amount will be less than or equal to that amount permitted by the environmental regulations.

DETAILED DESCRIPTION OF THE INVENTION

Hydrodesulfurization (HDS) processes are well known in the art. During such processes, an additional reaction occurs whereby the hydrogen sulfide produced during the process reacts with feed olefins to form alkylmercaptans. This reaction is commonly referred to as mercaptan reversion. Thus, to prevent such mercaptan reversion requires saturation of feed olefins resulting in a loss of octane.

It has been discovered, that the amount of mercaptan reversion sulfur compounds in the reactor is controlled by the equilibrium established by the reactor exit temperature, exit olefin and $H_2S$ partial pressure, and that the SCANfining process can be run to produce an amount of mercaptan reversion sulfur in the reactor that is often higher than the desired specification amount while removing non-mercaptan sulfur to an acceptable regulatory level. Thus, by running the SCANfiner, or other selective hydrodesulfurization process in such a manner, and combining it with a second step to remove the undesirable mercaptan reversion sulfur compounds produced, regulatory sulfur levels can be met while retaining octane in the product produced.

Hence, in the instant invention, the product of the HDS unit, which will have a mercaptan reversion sulfur content well above the desired specification but an acceptable non-mercaptan sulfur level (pre-determined), will be sent to a mercaptan removal step where at least a portion of the mercaptan reversion sulfur compounds will be selectively removed, thereby, producing a product that meets specification. By at least a portion, it is meant that at least about 30 wt %, preferably at least about 50 wt %, based on the petroleum feedstream. More preferably, at least that amount of meraptan reversion sulfur compounds is removed so that the naphtha produced by the present process meets environmental regulatory standards.

Because the removal or conversion of the mercaptan reversion sulfur compounds is readily accomplished by the instant invention, it is possible to operate the HDS unit to achieve a higher total sulfur level, thereby preserving feed olefins and octane.

For example, an intermediate cat naphtha can be hydroprocessed to 60 wppm total sulfur where approximately 45 wppm sulfur is mercaptan reversion sulfur. This first product would not meet the future 30 wppm sulfur specification. This product would then be sent to a removal step wherein at least a portion of the mercaptan reversion sulfur compounds would be removed to reduce the sulfur level of the first product to approximately 20 wppm total sulfur, meeting the specification. By hydroprocessing the sample only to 60 wppm total sulfur, olefin saturation will be less than is obtained from hydroprocessing to 20 wppm directly. Thus, considerable octane is preserved affording an economical and regulatory acceptable product.

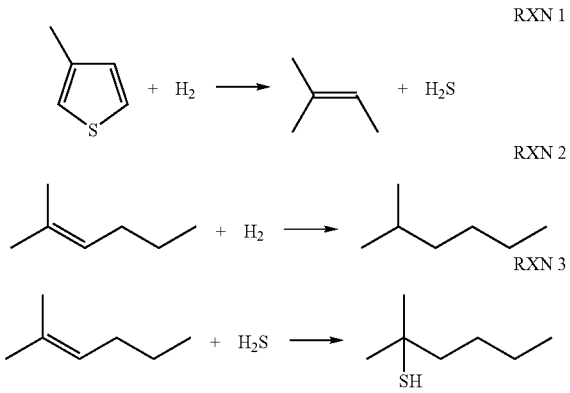

In the hydroprocessing reactor, cat naphtha and hydrogen are passed over a hydroprocessing catalyst where organic sulfur is converted to hydrogen sulfide (Rxn 1) and olefins are saturated to their corresponding paraffins (Rxn 2). In a typical intermediate cat naphtha organic sulfur species such as, for example, thiophenes, benzothiophenes, mercaptans, sulfides, disulfides and tetrahydrothiophenes are present. Typically greater than 95% of these organic sulfur species are in the form of thiophenic-type structures. When HDS is conducted at conditions described above to retain olefins, hydrogen sulfide from thiophene HDS reacts with feed olefins to form mercaptan reversion sulfur compounds (Rxn 3), referred to as mercaptan reversion herein. Mercaptan reversion (Rxn 3) occurs irrespective of whether or not the feed being desulfurized contains mercaptans. Thus, the sulfur compounds formed by mercaptan reversion are referred to as mercaptan reversion sulfur compounds.

The reaction that forms mercaptan reversion sulfur compounds (Rxn 3) was originally postulated to predominantly occur in the reactor effluent train rather than in the reactor due to more favorable thermodynamics. Hence, reactor effluent train product residence times were controlled to control the formation of mercaptan reversion sulfur compounds. The equilibrium constant at cold separator temperature (100° F., 38° C.) is approximately 500 to 1600, whereas the equilibrium constant at reactor temperature (575° F., 302° C.) is 0.006 to 0.03. Applicants discovered, upon a more rigorous examination of the thermodynamics of the system, that the level of mercaptan reversion sulfur compounds in products observed in pilot plants are thermodynamically allowed at reactor temperatures. Typical reactor ICN olefin partial pressures of 22 psi (152 kPa) would result in approximately 60 to 140 wppm sulfur as mercaptan reversion sulfur compounds, a result well above the currently proposed target of 30. It was clear from these thermodynamic calculations that mercaptan reversion is a limiting reaction for high selectivity cat naphtha hydroprocessing even at the high temperature reactor conditions.

The extent and location for mercaptan reversion will depend entirely on the relative reaction kinetics for the non-catalyzed reaction in the product recovery train vs. the catalyzed reaction that would occur in the reactor. It has been found that the rate of reaction under reactor conditions is extremely rapid, producing thermodynamic levels of mercaptan reversion sulfur compounds at very high space velocities, whereas the non-catalyzed reaction is relatively slow even at higher than the expected product recovery temperatures and $H_2S$ concentrations.

The HDS conditions needed to produce a hydrotreated naphtha stream which contains non-mercaptan sulfur at a level below the mogas specification as well as significant amounts of mercaptan reversion sulfur compounds will vary as a function of the concentration of sulfur and types of organic sulfur in the cracked naphtha feed to the HDS unit. Generally, the processing conditions will fall within the following ranges: 475-600° F. (246-316° C.), 150-500 psig (1136-3548 kPa) total pressure, 100-300 psig (791-2170 kPa) hydrogen partial pressure, 1000-2500 SCF/B hydrogen treat gas, and 1-10 LHSV.

Any hydrodesulfurization technology known to those skilled in the art that is capable of converting greater than 95% of the thiophenic sulfur in the feed can be used herein. However, the preferred hydroprocessing step to be utilized is SCANfining. It should also be noted that other selective cat naphtha hydrodesulfurization processes such as those taught by Mitsubishi (See U.S. Pat. Nos. 5,853,570 and 5,906,730 herein incorporated by reference) can likewise be utilized herein. SCANFINING is described in National Petroleum Refiners Association paper # AM-99-31 titled "Selective Cat Naphtha Hydrofining with Minimal Octane Loss" and U.S. Pat. Nos. 5,985,136 and 6,013,598 herein incorporated by reference. Selective cat naphtha HDS is also described in U.S. Pat. Nos. 4,243,519 and 4,131,537.

Typical SCANfining conditions include one and two stage processes for hydrodesulfurizing a naphtha feedstock comprising reacting said feedstock in a first reaction stage under hydrodesulfurization conditions in contact with a catalyst comprised of about 1 to 10 wt. % $MoO_3$; and about 0.1 to 5 wt. % CoO; and a Co/Mo atomic ratio of about 0.1 to 1.0; and a median pore diameter of about 60 [Angstrom] to 200 [Angstrom]; and a $MoO_3$ surface concentration in g $MoO^3/m^2$ of about $0.5\times10^{-4}$ to $3\times10^{-4}$; and an average particle size diameter of less than about 2.0 mm; and, optionally, passing the reaction product of the first stage to a second stage, also operated under hydrodesulfurization conditions, and in contact with a catalyst comprised of at least one Group VIII metal selected from the group consisting of Co and Ni, and at least one Group VI metal selected from the group consisting of Mo and W, more preferably Mo, on an inorganic oxide support material such as alumina.

In one possible flow plan for the invention, the SCANFINING reactor is run at sufficient conditions such that the difference between the total organic sulfur (determined by x-ray adsorption) and the mercaptan reversion sulfur (determined by potentiometric test ASTM3227) of the liquid product from the strippers is at or below the desired (target) specification (typically 30 ppm for non-mercaptan sulfur). This stream is then sent to a second step for removal of mercaptan reversion sulfur compounds.

In the step used to remove mercaptan reversion sulfur compounds, any technology known to the skilled artisan capable of removing $\geqq C_5$+ mercaptan reversion sulfur compounds can be employed. For example, sweetening followed by fractionation, thermal decomposition, extraction, adsorption and membrane separation. Other techniques which selectively remove $C_5$+ mercaptan reversion sulfur compounds of the type produced in the first step may likewise be utilized.

One possible method of removing or converting the mercaptan reversion sulfur compounds in accordance with step (b) of the instant process can be accomplished by sweetening followed by fractionation. Sweetening processes are known in the art and are described, for example, in U.S. Pat. No. 5,961,819. Such sweetening processes relating to the treatment of sour distillate hydrocarbons are described in many patents. For instance, U.S. Pat. Nos. 3,758,404; 3,977,829 and 3,992,156 which describe mass transfer apparatus and processes involving the use of fiber bundles which are particularly suitable for such processes.

Other methods for accomplishing oxidation (sweetening) of the mercaptan reversion sulfur compounds followed by fractionation are known and well-established in the petroleum refining industry. Among the oxidation processes which may be used to remove mercaptan reversion sulfur compounds are the copper chloride oxidation process, Mercapfining, chelate sweetening and Merox, of which the Merox process is preferred because it may be readily integrated with an extraction step in the final processing step for the back end.

In the Merox oxidation process, mercaptan reversion compounds are extracted from the feed and then oxidized by air in the caustic phase in the presence of the Merox catalyst, an iron group chelate (cobalt phthalocyanine) to form disulfides which are then redissolved in the hydrocarbon phase, leaving the process as disulfides in the hydrocarbon product. In the copper chloride sweetening process, mercaptan reversion sulfur compounds are removed by oxidation with cupric chloride which is regenerated with air which is introduced with the feed to oxidation step.

Whatever the oxidation process at this stage of the process, the mercaptan reversion compounds are converted to higher boiling disulfides which are transferred to the higher boiling fraction and subjected to hydrogenative removal together with the thiophene and other forms of sulfur present in the higher boiling portion of the cracked feed.

Oxidation processes for mercaptan reversion compounds are described in Modern Petroleum Technology, G. D. Hobson (Ed.), Applied Science Publishers Ltd., 1973, ISBN 085334 487 6, as well as in Petroleum Processing Handbook, Bland and Davidson (Ed.), McGraw-Hill, New York 1967, pages 3-125 to 3-130. The Merox process is described in Oil and Gas Journal 63, No. 1, pp. 90-93 (January 1965). Reference is made to these works for a description of these processes which may be used for converting the lower boiling sulfur components of the front end to higher boiling materials in the back end of the cracked feed.

Another method of removing the mercaptan reversion sulfur compounds in accordance with step (b) will employ a caustic mercaptan extraction step. In the instant invention, a combination of aqueous base and a phase transfer catalyst (PTC) known in the art will be utilized as the extractant or a sufficiently basic PTC.

The addition of a phase-transfer catalyst allows for the extraction of higher molecular weight mercaptan reversion compounds (≧C5+) produced during HDS into the aqueous caustic at a rapid rate. The aqueous phase can then be separated from the petroleum stream by known techniques. Likewise, lower molecular weight mercaptans reversion sulfur compounds, if present, are also removed during the process.

The phase transfer catalysts which can be utilized in the instant invention can be supported or unsupported. The attachment of the PTC to a solid substrate facilitates its separation and recovery and reduces the likelihood of contamination of the product petroleum stream with PTC. Typical materials used to support PTC are polymers, silicas, aluminas and carbonaceous supports.

The PTC and aqueous base extractant may be supported on or contained within the pores of a solid state material to accomplish the extraction of the mercaptan reversion sulfur compounds. After saturation of the supported PTC bed with mercaptide in the substantial absence of oxygen, the bed can be regenerated by flushing with air and a stripper solvent to wash away the disulfide which would be generated. If necessary, the bed could be re-activated with fresh base/PTC before being brought back on stream. This swing bed type of operation may be advantageous relative to liquid-liquid extractions in that the liquid-liquid separation steps would be replaced with solid-liquid separations typical of solid adsorbent bed technologies. Note, the substantial absence of oxygen is required if seeking to remove mercaptan reversion compounds as opposed to sweetening the HDS product to disulfides. By substantial absence is meant no more than that amount of oxygen which will be present in a refinery process despite precautions to exclude the presence of oxygen. Typically, 10 ppm or less, preferably 2 ppm or less oxygen will be the maximum amount present. Preferably, the process will be run in the absence of oxygen.

Such extractions include liquid-liquid extraction where aqueous base and water soluble PTC are utilized to accomplish the extraction, or basic aqueous PTC is utilized. A liquid-liquid extraction with aqueous base and supported PTC where the PTC is present on the surface or within the pores of the support, for example a polymeric support; and liquid-solid extraction where both the basic aqueous PTC or aqueous base and PTC are held within the pores of the support.

Thus, an "extractive" process whereby the thiols are first extracted from the petroleum feedstream in the substantial absence of air into an aqueous phase and the mercaptan reversion sulfur compound-free petroleum feedstream is then separated from the aqueous phase and passed along for further refinery processing can be conducted. The aqueous phase may then subjected to aerial oxidation to form disulfides from the extracted mercaptan reversion sulfur compounds. Separation and disposal of the disulfide would allow for recycle of the aqueous extractant. Regeneration of the spent caustic can occur using either steam stripping as described in The Oil and Gas Journal, Sept. 9, 1948, pp95-103 or oxidation followed by extraction into a hydrocarbon stream. Such extractants are easily selected by the skilled artisan and can include for example a reformate stream.

If it is desired to conduct a sweetening process, the extraction step can be conducted in air, the loss of thiol is concurrent with generation of disulfide. This indicates a "sweetening process", in that the total sulfur remains essentially constant in the feedstream, but the mercaptan sulfur is converted to disulfide. Furthermore, the thiol is transported from the organic phase into the aqueous phase, prior to conversion to disulfide then back into the petroleum phase. We have found this oxidation of mercaptides to disulfides to occur readily at room temperature without the addition of any other oxidation catalyst. When conducting a sweetening process, the extracting medium will consist essentially of aqueous base and PTC or aqueous basic PTC.

When utilizing a supported PTC, the porous supports may be selected from, molecular sieves, polymeric beads, carbonaceous solids and inorganic oxides for example.

Applicants believe that, higher molecular weight mercaptan reversion compounds are extracted from the petroleum feedstream into the basic solution that is contained within the pores of an appropriate solid support such as a "molecular sieve". This is achieved by bringing into contact the solid-supported aqueous basic solution with the petroleum stream by conventional methods such as are used in solid adsorbent technologies well known in the art. Upon contact, the mercaptide anion should be generated and transported into the aqueous phase within the pores of the molecular sieves. The mercaptan reversion sulfur compound-free petroleum effluent stream is now ready for normal processing. With time, the capacity of the bed will be exceeded and the thiol content of the effluent will rise. At this point the bed will need to be regenerated. A second adsorbent bed will be swung into operation. Regeneration of the first bed will be accomplished by introduction of oxygen (air) into the bed along with an organic phase, which will provide a suitable extractant stream for the disulfide, which should form upon oxidation of the mercaptide anions. The skilled artisan easily chooses such extractants. Pressure and heat could be used to stimulate the oxidative process. If necessary, the stripped bed could be regenerated by re-saturation with fresh base/PTC solution before being swung back into operation. Neither the base nor the PTC are consumed in this process, other than by losses due to contaminants. The advantage of using a supported PTC is that the mercaptans are trapped within the pores of the support facilitating separation.

Bases utilizable in the extraction step are strong bases, e.g., sodium, potassium and ammonium hydroxide, and sodium and potassium carbonate, and mixtures thereof. These may be used as an aqueous solution of sufficient strength, typically base will be up to or equal to 50 wt % of the aqueous medium, preferably about 15% to about 25 wt % when used in conjunction with onium salt PTCs and 30-50 wt % when used in conjunction with polyethyleneglycol type PTCs.

The phase transfer catalyst is present in a sufficient concentration to result in a treated feed having a decreased content of mercaptan reversion compounds. Thus, a catalytically effective amount of the phase transfer catalyst will be utilized. The phase transfer catalyst may be miscible or immiscible with the petroleum stream to be treated. Typically, this is influenced by the length of the hydrocarbyl chains in the molecule; and these may be selected by one skilled in the art. While this may vary with the catalyst selected, typically concentrations of about 0.01 to about 10 wt. %, preferably about 0.05 to about 1 wt % based on the amount of aqueous solution will be used.

Phase transfer catalysts (PTCs) suitable for use in this process include the types of PTCs described in standard references on PTC, such as *Phase Transfer Catalysis: Fundamentals, Applications and Industrial Perspectives* by Charles M. Starks, Charles L. Liotta and Marc Halpern (ISBN 0-412-04071-9 Chapman and Hall, 1994). These reagents are typically used to transport a reactive anion from an aqueous phase into an organic phase in which it would otherwise be insoluble. This "phase-transferred" anion then undergoes reaction in the organic phase and the phase transfer catalyst then returns to the aqueous phase to repeat the cycle, and hence is a "catalytic" agent. In the invention, it is believed that, the PTC transports the hydroxide anion, $^{-}OH$, into the petroleum stream, where it reacts with the thiols in a simple acid base reaction, producing the deprotonated thiol or thiolate anion. This charged species is much more soluble in the aqueous phase and hence the concentration of thiol in the petroleum stream is reduced by this chemistry.

A wide variety of PTC would be suitable for this application. These include onium salts such as quaternary ammonium and quaternary phosphonium halides, hydroxides and hydrogen sulfates for example. When the phase transfer catalyst is a quaternary ammonium hydroxide, the quaternary ammonium cation will preferably have the formula:

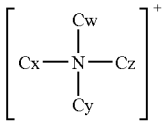

where $q=1/w+1/x+1/y+1/z$ and wherein $q \geqq 1.0$. Preferably, $q \geqq 3$. In this formula, Cw, Cx, Cy, and Cz represent alkyl radicals with carbon chain lengths of w, x, y and z carbon atoms, respectively. The preferred quaternary ammonium salts are the quaternary ammonium halides.

The four alkyl groups on the quaternary cation are typically alkyl groups with total carbons ranging from four to forty, but may also include cycloalkyl, aryl, and arylalkyl groups. Some examples of useable onium cations are tetrabutyl ammonium, tetrabutylphosphonium, tributylmethyl ammonium, cetyltrimethyl ammonium, methyltrioctyl ammonium, and methyltricapryl ammonium. In addition to onium salts, other PTC have been found effective for hydroxide transfer. These include crown ethers such as 18-crown-6 and dicyclohexano-18-crown-6 and open chain polyethers such as polyethyleneglycol 400. Partially-capped and fully-capped polyethyleneglycols are also suitable. This list is not meant to be exhaustive but is presented for illustrative purposes. Supported or unsupported PTC and mixtures thereof are utilizable herein.

The amount of aqueous medium to be added to said petroleum stream being treated will range from about 5% to about 200% by volume relative to petroleum feed.

While process temperatures for the extraction of from 25° C. to 180° C. are suitable, lower temperatures of less than 25° C. can be used depending on the nature of the feed and phase transfer catalyst used. The pressure should be sufficient pressure to maintain the petroleum stream in the liquid state. Oxygen must be excluded, or be substantially absent, during the extraction and phase separation steps to avoid the premature formation of disulfides, which would then redissolve in the feed. Oxygen is necessary for a sweetening process.

Following the extraction of the mercaptan reversion sulfur compounds, and separation of the mercaptan reversion sulfur compound free petroleum stream, the stream is then passed through the remaining refinery processes, if any. The base and PTC or basic PTC may then be recycled for extracting additional mercaptans from a fresh hydrodesulfurized petroleum stream.

The mixture of PTC and base may consist essentially of or consist of PTC and base. When using basic PTCs, they may consist essentially of or consist of basic PTC's. Preferably, the invention will be practiced in the absence of any catalyst other than the phase transfer catalyst such as those used to oxidize mercaptans reversion sulfur compounds, e.g. metal chelates as described in U.S. Pat. Nos. 4,124,493; 4,156,641; 4,206,079; 4,290,913; and 4,337,147. Hence in such cases the PTC will be the only catalyst present.

The conditions under which the HDS unit is operated are chosen such that organic sulfur species present in the feed (e.g. thiophenes, benzothiophenes, mercaptans, sulfides, disulfides and tetrahydrothiophenes) are substantially converted into hydrogen sulfide without significantly impacting olefin saturation. By substantially converted, it is meant that greater than 95% of the organic sulfur species present in the feed are converted into hydrogen sulfide without significantly impacting olefin saturation. As previously mentioned, greater than 95% of these organic sulfur species are present in the form of thiophenic-type sulfur species. Thus, it is preferred to operate the HDS unit in such a manner that greater than 95% of the thiophenic-type sulfur species are converted. Olefin saturation will thus, only occur to the extent caused by the HDS organic sulfur conversion conditions. Such conditions are easily selected by the skilled artisan.

Once the naphtha having organo sulfur species and mercaptan reversion compounds removed therefrom is separated from the extractant mixture, the extractant mixture can then be recycled to extract a fresh hydroprocessed stream. The preferred streams treated in accordance herewith are naphtha streams, more preferably, intermediate naphtha streams. Regeneration of the spent caustic can occur using either steam stripping as described in The Oil and Gas Journal, Sept. 9, 1948, pp95-103 or oxidation followed by extraction into a hydrocarbon stream.

Typically regeneration of the mercaptan reversion sulfur compound containing caustic stream is accomplished by mixing the stream with an air stream supplied at a rate which supplies at least the stoichiometric amount of oxygen necessary to oxidize the mercaptan reversion sulfur compounds in the caustic stream. The air or other oxidizing agent is well admixed with the liquid caustic stream and the mixed-phase admixture is then passed into the oxidation zone. The oxidation of the mercaptan reversion sulfur compounds is promoted through the presence of a catalytically effective amount of an oxidation catalyst capable of functioning at the conditions found in the oxidizing zone. Several suitable materials are known in the art.

Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo, and tetrasulfo derivatives.

The preferred oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. Carrier materials should be highly absorptive and capable of withstanding the alkaline environment. Activated charcoals have been found very suitable for this purpose, and either animal or vegetable charcoals may be used. The carrier material is to be suspended in a fixed bed, which provides efficient circulation of the caustic solution. Preferably the metal phthalocyanine compound comprises about 0.1 to 2.0 wt. % of the final composite.

The oxidation conditions utilized include a pressure of from atmospheric to about 6895 Kpag (1000 psig). This pressure is normally less than 500 kPag (72.5 psig). The temperature may range from ambient to about 95 degrees Celsius (203 degrees Fahrenheit) when operating near atmospheric pressure and to about 205 degrees Celsius (401 degrees Fahrenheit) when operating at superatmospheric pressures. In general, it is preferred that a temperature within the range of about 38 to about 80 degrees Celsius is utilized.

To separate the mercaptan reversion sulfur compounds from the caustic, the pressure in the phase separation zone may range from atmospheric to about 2068 Kpag (300 psig) or more, but a pressure in the range of from about 65 to 300 kPag is preferred. The temperature in this zone is confined within the range of from about 10 to about 120 degrees Celsius (50 to 248 degrees Fahrenheit), and preferably from about 26 to 54 degrees Celsius. The phase separation zone is sized to allow the denser caustic mixture to separate by gravity from the disulfide compounds. This may be aided by a coalescing means located in the zone.

Another possible means for conducting step (b) of the process involves catalytic decomposition. The catalytic decomposition of mercaptan reversion sulfur compounds to form olefins and $H_2S$ at high temperature vapor conditions is well known in the art. One such patent describing this process is U.S. Pat. No. 6,387,249 B1, Cook et al., which is incorporated herein by reference. Simple, non-catalyzed thermal decomposition is well known to be quite slow for primary mercaptan (W. M. Malisoff and E. M. Marks, Industrial and Engineering Chemistry 1931, 23, pp 1114-1120), requiring temperatures in excess of 400° C. in order to achieve greater than 10% conversion. A catalyst is therefore preferred. A wide variety of solid oxides are well known to catalyze this reaction. Typical materials utilized to catalyze this reaction are described in C. P. C. Bradshaw and L. Turner British Patent No. 1,174,407, December 1969. For example 32% conversion of 2-butanethiol is obtained over an alumina catalyst at 250° C.; LHSV of 6 and 1 atmosphere. Mixed solid oxides, such as amorphous and crystalline silica-alumina are also well known to catalyze this reaction. Although traditional metal sulfide catalyst are also suitable for this reaction, a solid oxide would be preferred due to the absence of a olefin hydrogenation function on the catalyst.

For example, the catalyst may be selected from: alumina, silica, titania, Group IIA metal oxides, mixed oxides of aluminum and Group IIA metals, silica-alumina, crystalline silica-alumina, aluminum phosphates, crystalline aluminum phosphates, silica-alumina phosphates, Group VI metal sulfides, and Group VIII metal promoted Group VI metal sulfides and mixtures thereof.

The preferred catalyst may be selected from: alumina, silica, titania, Group IIA metal oxides, mixed oxides of aluminum and Group IIA metals, silica-alumina, crystalline silica-alumina, aluminum phosphates, crystalline aluminum phosphates, silica-alumina phosphates and mixtures thereof. The most preferred catalyst is alumina.

In one embodiment of this invention the reactor effluent from SCANfining is condensed in a separation drum, and gaseous products of the HDS reaction such as $H_2S$ are separated from the liquid product. The liquid product is then sent to a stripper or stablizer vessel where dissolved $H_2S$ and light hydrocarbons are removed. The liquid from the stripper/stabilizer is then heated to vaporization at a pressure between atmospheric pressure and 200 psig (1480 kPa). This vapor feed and hydrogen is then sent to an additional mercaptan reversion compound decomposition reactor that contains a catalyst suitable for decomposing the mercaptan reversion compounds, while not saturating the desired feed olefins. Non-limiting examples of such catalysts are described above. Typical temperatures for this reactor would be temperatures of 200-450° C., pressure from atmospheric to 200 psig and hydrogen treat rates of 100-5000 SCF/B. It is understood that the temperature and pressure chosen must be such as to produce a complete vaporous feed to the reactor. Subsequent to the reaction the now mercaptan free product is condensed in another separation drum and then stripped of any remaining dissolved $H_2S$ in a additional stripper.

In a second embodiment of this invention the mercaptan reversion sulfur compound decomposition reactor is placed immediately following the first separation drum and sent without stripping directly to the mercaptan reversion sulfur compound decomposition reactor at the conditions described above. This embodiment removes the requirement for an intermediate stripper and although it will result in some H2S in the mercaptan reversion sulfur compound destruction reactor, this can be overcome by running the mercaptan reversion sulfur compound reactor at slightly higher temperature and/or lower pressure to compensate and is readily accomplished by the skilled artisan.

Thus, the process may involve two steps. First, a cracked naphtha, which may be a cat naphtha, coker naphtha, steam cracked naphtha or a mixture thereof, containing quantities of undesirable sulfur species and desirable high octane olefinic species is treated in a selective hydrotreating process (for example SCANfining). The selective hydrotreating process removes mercaptan and non-mercaptan (e.g. thiophenic) sulfur species from the feed with a minimum saturation of olefins. During this desulfurization process, $H_2S$ is liberated and reacts with olefins in the naphtha product to form mercaptan reversion sulfur compounds. Conditions in the selective naphtha hydrotreating process are chosen to reduce the level of non-mercaptan sulfur species in the product to preferably less than 30 wppm. The second step involves removing the mercaptan reversion sulfur compounds formed in the first step. A variety of techniques can be used to accomplish this while minimizing olefin saturation and hence octane lost. These include: sweetening and fractionation, extraction, adsorption, mild hydrotreating, and thermal decomposition. The final naphtha product from the two step sequence has very low sulfur content (i.e. 30 ppm or less) and increased octane.

The product from the instant process is suitable for blending to make motor gasoline that meets sulfur specifications in the 30 ppm range and below.

The following examples, which are meant to be illustrative and not limiting, illustrate the potential benefit of the invention, by showing specific cases in which a selective hydrofining process has been operated to produce varying levels of total and mercaptan sulfur. By reference to these cases, it should be apparent that coupling such selective hydrotreating with a subsequent mercaptan reversion sulfur compound removal technology will result in improved ability to produce low sulfur products with reduced losses of olefins and octane.

EXAMPLES

Example 1

A sample of naphtha product from a commercial Fluid Catalytic Cracking unit was fractionated to provide an intermediate cat naphtha (ICN) stream having a nominal boiling range of 180-370° F. The ICN stream contained 3340 wppm sulfur and 32.8 vol % olefins (measured by FIA) and had a Bromine number of 50.7. The ICN stream was hydrotreated at SCANfining conditions using RT-225 catalyst at 500° F., 250 psig, 1500 SCF/B hydrogen treat gas and 0.5 LHSV. The SCANfiner product contained 93 wppm sulfur and had a Bromine number of 19.4. Of the 93 wppm sulfur, 66 wppm was mercaptan reversion sulfur and the remainder was non-mercaptan sulfur. The SCANfiner product was sweetened by contacting it in air with a solution of 20 wt % NaOH in water and 500 wppm cetyltrimethylammonium bromide in water. The resulting sweetened SCANfiner product contained 5 wppm mercaptan reversion sulfur. The sweetened SCANfiner product was then fractionated via a 15/5 distillation to achieve a 350° F. cut point. 90 wt % was recovered as 350° F.–desulfurized product which contained 21 wppm total sulfur, 5 wppm mercaptan sulfur and had a Bromine number of 19.5. The remaining 350° F.+ product contained 538 wppm sulfur consisting primarily of high boiling disulfides from the sweetening step. The desulfurized 350° F.– product is suitable for blending into low sulfur gasoline. The 350° F.+ product can be processed further via hydrotreating to remove the disulfides.

Comparative Example

The ICN stream of Example 1 was hydrotreated at SCANfining conditions using RT-225 catalyst at 525° F., 227 psig, 2124 SCF/B hydrogen treat gas and 1.29 LHSV. The SCANfiner product contained 35 wppm sulfur and had a Bromine number of 10.1. Although this SCANfiner product had <50 ppm S total sulfur content like the 350° F.– product of Example 1, the Bromine number was significantly lower (10.1 vs 19.5) indicating the olefin content was lower resulting in increased octane loss.

Example 2

A commercially prepared, catalyst (RT-225) consisting of 4.34 wt % $MoO_3$, 1.19 wt % CoO. SCANfining operation was demonstrated using a catalyst in a commercially available 1.3 mm asymmetric quadralobe size with a Heavy Cat Naphtha feed, 2125 wppm total sulfur, and 27.4 bromine number, in an isothermal, downflow, all vapor-phase pilot plant. Catalyst volume loading was 35 cubic centimeters. Reactor conditions were 560° F., 2600 scf/b, 100% hydrogen treat gas and 300 psig total inlet pressure. Due to small random changes that occured while adjusting pump settings, space velocity was varied between 3 and 5 LHSV (defined as volume of feed per volume of catalyst per hour). Overall sulfur removal levels ranged between 93.9 and 98.5% and olefin saturation between 21.9 and 35.8%. FIG. 1, shows product sulfur levels, both total and product sulfur less mercaptan reversion sulfur, as a function of olefin saturation. To make 30 ppm sulfur in the product without mercaptan sulfur removal would require approximately 34% olefin hydrogenation compared to 26.5% with mercaptan reversion sulfur compound removal. If lower sulfur levels were required, this difference in olefin hydrogenation would be even higher. It should be noted that the three lowest sulfur data points at the highest olefin saturation or bromine number removal were obtained near the start of the pilot plant run (11 to 13 days on cat naphtha). It is known that as the catalyst ages or cokes, selectivity for sulfur removal over olefin hydrogenation is improved. As a result, this example may slightly exaggerate the potential benefit of mercaptan sulfur removal post SCANfining since the other data points were collected near end of run (29 to 33 days on cat naphtha).

Example 3

Figure 2:
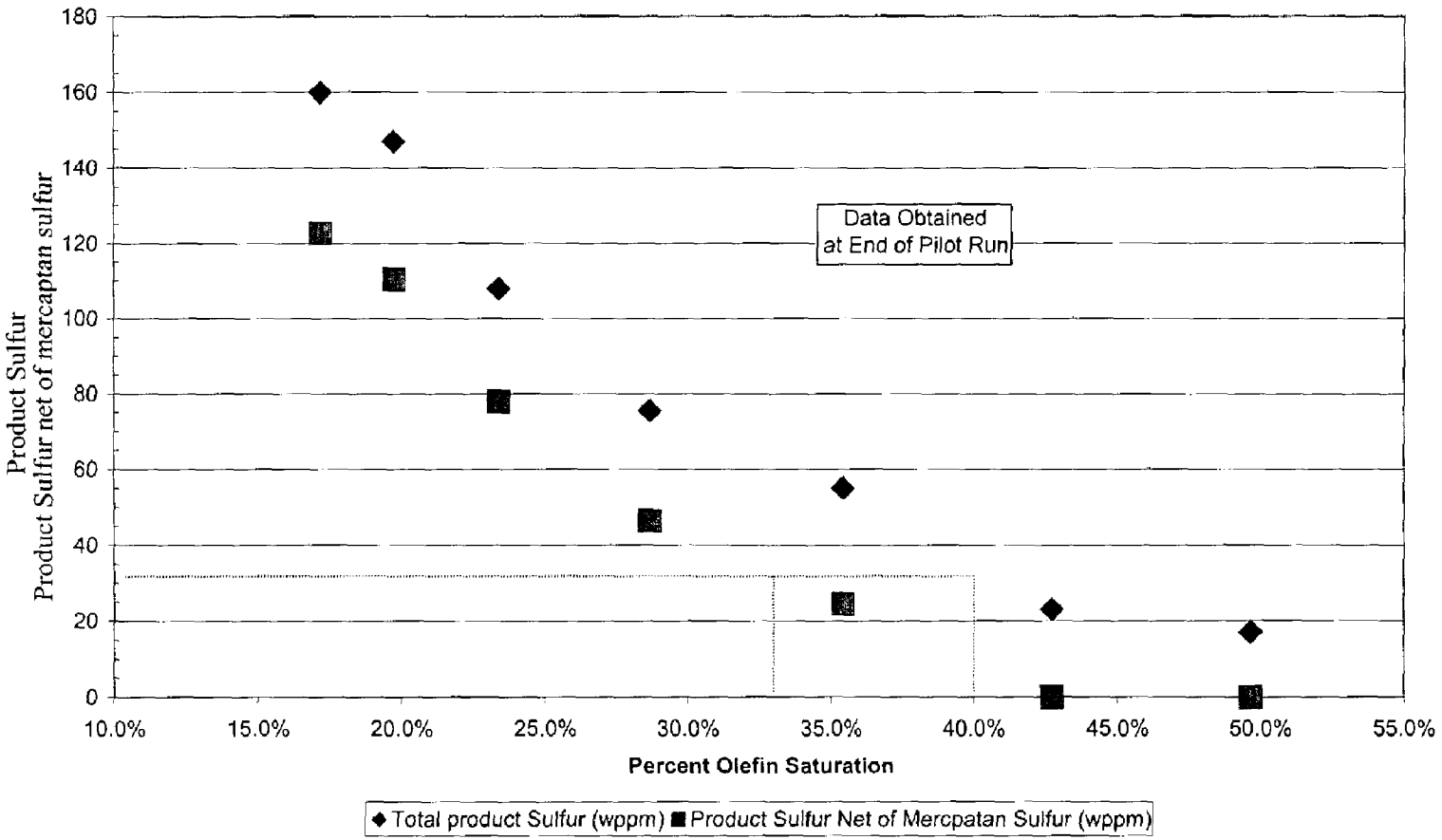
FIG. 2 illustrates the degree to which mercaptan reversion can limit HDS of HCN using a KF 742 catalyst. The Y axis shows both total product sulfur (wppm), and product sulfur minus sulfur resulting from reversion mercaptans (wppm). The X axis is percent olefin saturation.

A commercially prepared, reference batch of KF-742 (10 cc charge) conventional hydrotreating catalyst was used in this test. The catalyst (KF-742) consisted of 15.0 wt % $MoO_3$, 4.0 wt % CoO. The SCANfining operation was demonstrated using a catalyst in a commercially available 1.3 mm asymmetric quadralobe size with a Heavy Cat Naphtha feed, 2125 wppm total sulfur, and 27.4 bromine number in an isothermal, downflow, all vapor-phase pilot plant. Reactor conditions were 560° F., 2600 scf/b, 100% hydrogen treat gas and 300 psig total inlet pressure. For this test, space velocity was adjusted between 7 and 28 LHSV and all of the data was collected near end of run (30 to 38 days on cat naphtha). Each day, a small decrease in feed rate was made. Overall sulfur removal levels ranged between 92.5 and 99.2% and olefin saturation between 21.9 and 35.8%. FIG. 2, shows product sulfur levels, both total and product sulfur less mercaptan reversion sulfur, as a function of olefin saturation. To make 30 ppm sulfur in the product without mercaptan sulfur removal would require approximately 40% olefin hydrogenation compared to 33%. If lower sulfur levels were required, this difference in olefin hydrogenation or octane loss would be even higher. It should be noted that for the last two points, measured mercaptan reversion sulfur was slightly greater than total sulfur measured. As a result, all sulfur was assumed to be mercaptan reversion sulfur.

Example 4

A sample of ICN (3340 wppm total sulfur and 50.7 bromine number) was SCANfined in an isothermal, downflow, all vapor-phase pilot plant using RT-225 high dispersion catalyst mentioned in Example 1. Examples are shown in Table 1 which shows that mercaptan reversion products form a large percentage of the remaining product sulfur.

TABLE 1

| Examples of Mercaptan Reversion | | | |
|---|---|---|---|
| Balance | 9 | 12 | 23 |
| Reactor Operation | | | |
| Temp ° C. | 274 | 302 | 274 |
| Pressure kPa | 1653 | 1653 | 1653 |
| LHSV | 1.15 | 3.5 | 2.5 |
| Treat gas rate scf/bbl | 2200 | 2200 | 2200 |
| Product Analysis | | | |
| Total Sulfur | 34 | 38 | 287 |
| Mercaptan sulfur | 33.2 | 32.4 | 88.5 |

Example 5

A previously hydroprocessed intermediate cat naphtha containing 60 wppm total sulfur, 43 wppm sulfur as mercaptan reversion sulfur and a bromine number of 19.3 was subjected to catalytic mercaptan destruction over a g-alumina catalyst in fixed bed microreactor at the following conditions. As can be seen by the data below extremely high mercaptan reversion sulfur compound conversions (>90%) is achieved at almost all of the vapor conditions shown. It is also obvious from the data that higher temperatures and treat rates favor mercaptan reversion compound decomposition.

TABLE 2

| Catalytic Decomposition of Mercaptans in Intermediate Cat Naphtha over g-Alumina | | | | | | | |
|---|---|---|---|---|---|---|---|
| Temp ° C. | 250 | 300 | 300 | 300 | 300 | 300 | 300 |
| Pressure (kPa) | 446 | 446 | 446 | 446 | 446 | 446 | 446 |
| $H_2$ treat rate | 5400 | 5400 | 1700 | 1700 | 1700 | 850 | 850 |
| LHSV | 1.0 | 1.0 | 1.0 | 2.0 | 4.0 | 4.0 | 4.0 |
| % mercaptan decomposed | 98 | 100 | 95 | 97 | 95 | 91 | 84 |

What is claimed is:

1. A method for producing a naphtha having a decreased amount of sulfur comprising the steps of:

a) selectively hydroprocessing a petroleum feedstream comprising cracked naphtha and sulfur-containing species said hydroprocessing performed at selective hydroprocessing conditions effective to convert greater than 95% of the organic sulfur species in said petroleum feedstream to produce a first naphtha product, said first naphtha product containing mercaptan reversion sulfur species having more than 5 carbon atoms, olefins, and non-mercaptan sulfur, wherein said mercaptan reversion sulfur species having more than 5 carbon atoms are produced during said selective hyproprocessing; and b) removing or converting said mercaptan reversion sulfur species with the use of a phase transfer catalyst from said first naphtha product to obtain a second product having a decreased amount of mercaptan reversion sulfur species.

2. The method of claim 1 wherein said first naphtha product contains less than 50 ppm non-mercaptan sulfur.

3. The method of claim 1 wherein said first naphtha product contains less than 30 wppm non-mercaptan sulfur.

4. The process of claim 1 wherein said second step (b) comprises:

i) extracting said first petroleum product, in the substantial absence of oxygen, with an extractant comprising an aqueous base and a catalytically effective amount of a phase transfer catalyst or an aqueous solution of a catalytically effective amount of a basic phase transfer catalyst to remove said mercaptans from said naphtha product; and ii) separating and recovering a used extractant stream containing mercaptide anions and a second petroleum naphtha product stream having a decreased amount of mercaptan reversion sulfur compounds.

5. The method of claim 4 wherein said phase transfer catalysts are selected from the group consisting of is selected from the group consisting essentially of onium salts, crown ethers, open chain polyethers, and mixtures thereof.

6. The process of claim 4 wherein said onium salts are selected from the group consisting of quaternary ammonium hydroxides, quaternary ammonium halides, quaternary ammonium hydrogen sulfates and mixtures thereof.

7. The process of claim 6 wherein said phase transfer catalyst is selected from polyethylene glycol, tetrabutylammonium hydroxide, cetyltrimethylammonium bromide, and tetrabutylphosphonium, tributylmethyl ammonium, methyltrioctyl ammonium and methyltricapryl ammonium salts, and mixtures thereof.

8. The process of claim 4 wherein said base is selected from the group consisting of sodium hydroxide, potassium hydroxide, ammonium hydroxide, sodium carbonate, potassium carbonate, and mixtures thereof.

9. The process of claim 4 wherein said phase transfer catalyst is added in amounts of about 0.01 to about 10 wt. % of said extractant.

10. The process of claim 9 wherein said base is added in amounts of up to about 50 wt % of said extractant.

11. The process of claim 4 wherein at least about 70% of the mercaptan reversion sulfur compounds are removed.

12. The process of claim 1 wherein said cracked naphtha is selected from the group consisting essentially of cat naphtha, coker naphtha, steam cracked naphtha and mixtures thereof.

13. The process of claim 1 wherein step (b) comprises catalytic decomposition using a catalytically effective amount of a phase transfer catalyst or an aqueous solution of a catalytically effective amount of a basic phase transfer catalyst to remove said mercaptans from said first naphtha product, wherein the phase transfer catalyst is selected from the group consisting of onium salts, crown others, open chain polyethers, and mixtures thereof.

* * * * *